United States Patent [19]

Schmelzer et al.

[11] 4,350,460

[45] Sep. 21, 1982

[54] VIBRATORY COMPACTION SYSTEM

[75] Inventors: Lynn A. Schmelzer; W. Thomas Fouser, both of Kewanee, Ill.

[73] Assignee: Hyster Company, Portland, Oreg.

[21] Appl. No.: 131,936

[22] Filed: Mar. 21, 1980

[51] Int. Cl.[3] ..... E01C 19/38

[52] U.S. Cl. ..... 404/117; 74/87; 464/179

[58] Field of Search ..... 404/117; 64/1 R, 8, 64/23; 74/87, 61

[56] References Cited

U.S. PATENT DOCUMENTS

| | | | |
|---|---|---|---|
| 2,078,715 | 4/1937 | Lurz | 74/61 |
| 2,144,447 | 1/1939 | Barnhart | 74/424.8 |
| 2,660,067 | 11/1953 | Glover | 74/87 |
| 2,930,244 | 3/1960 | Hutchinson | 74/87 X |
| 2,937,537 | 5/1960 | Woll | 74/61 |
| 3,145,631 | 8/1964 | Green | 404/117 |
| 3,192,839 | 7/1965 | Vivier | 404/117 |
| 3,590,702 | 7/1971 | Sechi | 404/117 |
| 3,640,508 | 2/1972 | Reibig | 74/87 X |
| 3,722,381 | 3/1973 | Tuneblom | 74/87 X |
| 3,814,532 | 6/1974 | Barrett | 404/117 |
| 3,901,617 | 8/1975 | Herbst | 404/117 |
| 3,909,147 | 9/1975 | Takata | 404/117 |
| 4,043,146 | 8/1977 | Stegherr | 64/1 V |
| 4,108,009 | 8/1978 | Fuchigami | 74/61 |
| 4,152,943 | 5/1979 | Wall | 74/87 |
| 4,221,499 | 9/1980 | Brietholz | 404/117 |

OTHER PUBLICATIONS

Brochure for Hyster Model C620B, Self Propelled Vibratory Soils Compactor, 10/75, Hyster Co., Equipment Division.

*Primary Examiner*—Nile C. Byers, Jr.
*Attorney, Agent, or Firm*—Klarquist, Sparkman, Campbell, Leigh, Whinston & Dellett

[57] ABSTRACT

A vibratory compactor vehicle includes a roller drum provided with internal concentrically mounted eccentric weights which are rotated for imparting vibration to the drum. The weights are mounted upon concentric shafts of helical polygonal shape having mating, helically ribbed and grooved surfaces, whereby longitudinal movement of one of the shafts with respect to the other brings about relative rotation of the weights, thereby changing the amplitude of the resulting vibration.

14 Claims, 10 Drawing Figures

VIBRATORY COMPACTION SYSTEM

RELATED APPLICATIONS

This application is directed to an improvement of the subject matter of copending application of Kenneth E. Brooks, Ser. No. 123,507, filed Feb. 22, 1980, entitled "Vibratory Compaction System."

BACKGROUND OF THE INVENTION

The present invention relates to a vibratory compaction system and particularly to such a system having a simplified and rugged construction and an infinitely variable amplitude of vibration.

Compactor vehicles provided with vibratory rollers are used in compacting road surfaces and the like including dirt or asphalt. The vibration is suitably brought about by means of eccentric weights attached to the roller in some manner and rotated comparatively rapidly for imparting a vibratory force to the roller. Of course the extent of vibration desired may depend upon the surface materials employed and the degree of compaction desired, and therefore the amplitude of vibration is preferably adjustable. Various systems have been proposed heretofore for adjusting the degree or amplitude of vibration, but many have suffered from certain difficulties. For instance, a common drawback relates to a requirement for stopping a vehicle in order to change or adjust the positioning of weights and therefore the extent of vibration. Other systems allow for change in vibratory amplitude during operation of the vehicle, but the adjustment is found to be somewhat limited or produces only a change from maximum to minimum vibration amplitude. Some vehicles require a rotating hydraulic connection between the moving drum and the control apparatus.

Other systems have been proposed which are relatively complex in their organization and lack structural durability. For example, a pin and camming slot arrangement has been suggested for producing relative rotation of eccentric weights. However, such a system does not provide for the ease of operation and ruggedness required in a compactor vehicle.

SUMMARY OF THE INVENTION

In accordance with a preferred embodiment of the present invention, a vibratory compaction system includes a pair of concentric shafts positioned coaxially with the compactor drum and adapted for respectively rotating eccentric weights positioned within the drum. The shafts having a driving connection therebetween, preferably comprising mating helically grooved and ribbed surfaces extending along an appreciable length thereof to provide a structurally reliable connection while facilitating relative rotation between the shafts. In the preferred embodiment, a linear actuator moves the driving connection axially with respect to the concentric shafts, and the mating helically ribbed and grooved surfaces cause relative rotation between the shafts and consequent relative rotation of the eccentric weights within the drum.

In the preferred embodiment, the mating grooved and ribbed surfaces are polygonal in cross section, i.e., the exterior of the inner concentric shaft takes the form of a polygon in cross section for mating with a similarly configured internal cross section on the outer concentric shaft. This configuration is found to have improved constructional ruggedness and reliability, while at the same time enabling adjustment of vibration amplitude.

In the preferred embodiment, a straight splined driving connection between a second of the shafts and a second eccentric weight enables relative longitudinal movement between said second shaft and said second eccentric weight, as well as relative rotation of said second eccentric weight with respect to a first concentric weight. However, the latter splined connection is not a necessity. Alternatively, a straight splined driving connection can be employed between first and second shafts with a helically ribbed and grooved driving connection relating the second shaft and the second eccentric weight. Alternatively, both driving connections can be helical if so desired.

It is accordingly an object of the present invention to provide an improved vibratory compaction system wherein adjustment of the amplitude of vibration during operation is facilitated.

It is another object of the present invention to provide and improved vibratory compaction system which is simpler in construction and more reliable in operation than those available heretofore.

It is another object of the present invention to provide an improved vibratory compaction system for a compactor vehicle which system exhibits improved structural ruggedness and reliability, enables infinite variation of the amplitude of vibration between a maximum and minimum vibration condition, enables such adjustment of vibration amplitude during rotation of the vehicles compaction drum, and provides for reversibility of the direction of rotation of the vibration generating mechanism.

The subject matter which we regard as our invention is particularly pointed out and distinctly claimed in the concluding portion of this specification. The invention, however, both as to organization and method of operation, together with further advantages and objects thereof, may best be understood by references to the following description taken in connection with the accompanying drawings wherein like reference characters refer to like elements.

DRAWINGS

DETAILED DESCRIPTION

Figure 1:
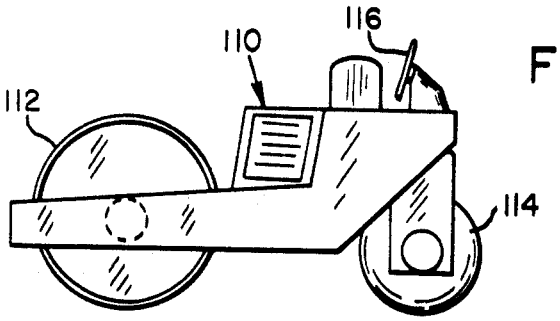
FIG. 1 is a side view of a compactor vehicle with which the system according to the present invention will be employed.

Referring to FIG. 1, a compactor vehicle with which the present invention is designed to be employed comprises a main frame 110 supported at its rearward end by a hollow, steel roller drum 112, and at its forward end by a second drum or tire 114 steerable by a steering wheel 116. The drum 112 is internally provided with a pair of rotatable eccentric weights, as hereinafter more fully described. These impart a vibration to the drum, actually causing the same to rotate about an epicenter between the resultant center of mass for the drum and the center of mass for the eccentric weight. The distance from the center of mass of the drum and the epicenter of rotation is called amplitude, and this amplitude is conveniently varied in accordance with the apparatus of the present invention. The ability to vary the vibratory effect is useful for the compaction of a variety of base materials, dirt and various road construction materials including asphalt.

Figure 2:
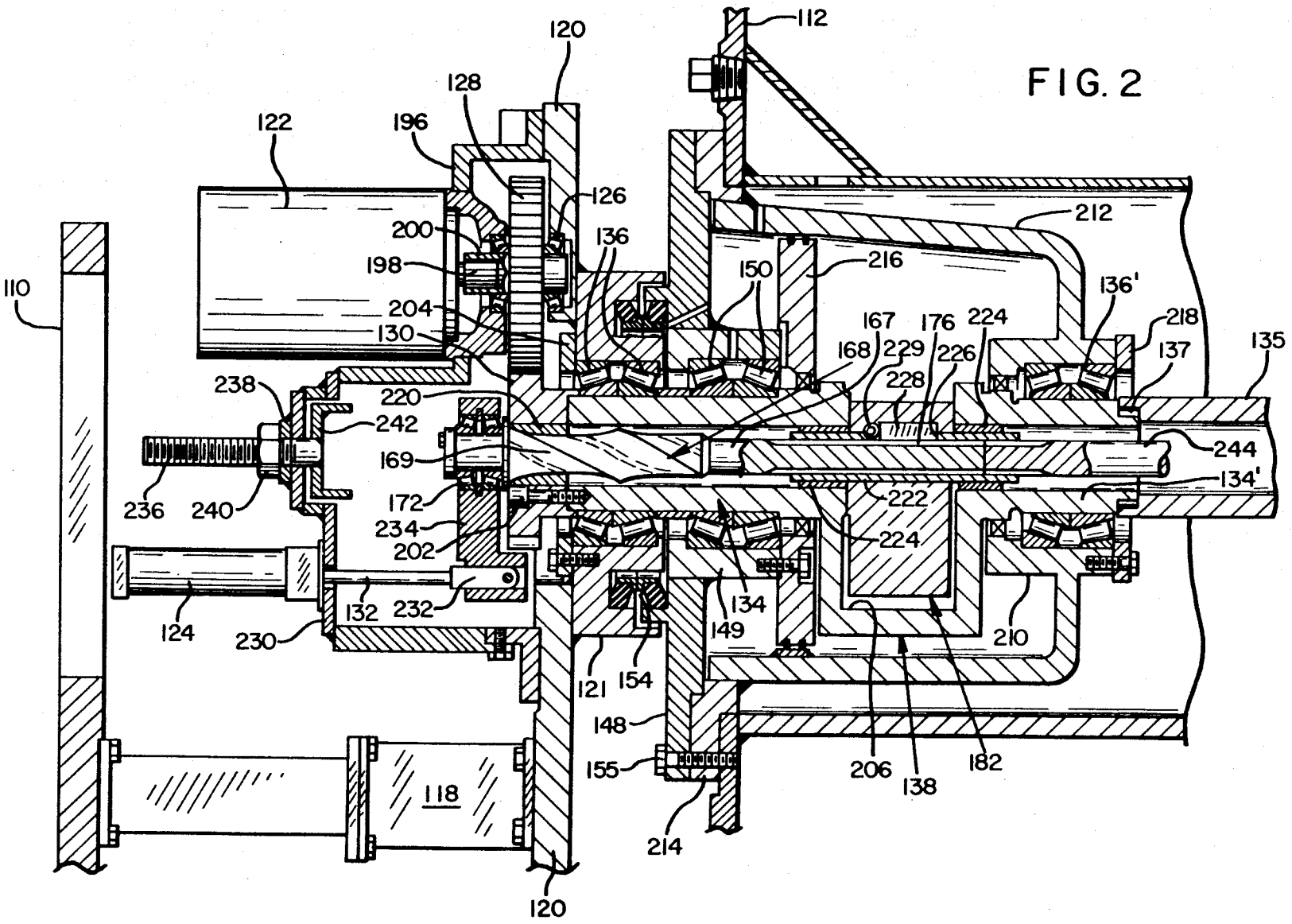
FIG. 2 is a longitudinal cross section, partially broken away, through the drum and compaction system according to a preferred embodiment of the present invention.

Referring to FIG. 2, a vibratory system according to the present invention is illustrated in greater detail. Drum 112 is ultimately attached to vehicle frame 110 via four rubber isolators (one of which is illustrated in FIG. 2), these isolators supporting the shaft system about which the drum 112 rotates. Isolator bracket or plate 120 extends between a pair of the isolators 118 at the left-hand side of the drum shown and carries a reversible vibrator drive motor 122 as well as a linear actuator in the form of a double-acting hydraulic cylinder 124. The outer end of the shaft of motor 122 rotates in bearings 126 provided in bracket 120, said shaft having drive gear 128 mounted thereupon for engaging vibrator driven gear 130. Gear 130 is secured upon a first hollow eccentric weight shaft 134 which rotates within bearings 136 carried by bracket 120 as motor 122 imparts rotation to gears 128 and 130. Axially inward of the drum 112, shaft 134 is integral with a first eccentric weight 138. The eccentric weight 138 is off center with respect to shaft 134 whereby rotation thereof as caused by rotation of shaft 134 imparts a first component of vibration to the drum.

A preferred embodiment of the present invention as incorporated within compaction drum 112 is illustrated in FIG. 2. Isolator bracket 120 is mounted from isolators 118 and supports vibrator drive motor 122 by way of shroud support 196. Motor shaft 198 is keyed to gear shaft 200, the remote end of which is rotatable in bearings 126 and upon which is mounted drive gear 128 disposed in mating engagement with vibrator driven gear 130. Gear 130 is secured upon hollow eccentric weight shaft 134, e.g., by screws 202, said shaft rotating within bearings 136 carried by annular member 121 which is secured to bracket 120. A bearing retainer ring 204 is also positioned against the exterior side of member 121.

Axially inwardly of drum 112, the shaft 134 is integral with first eccentric weight 138 which in this embodiment is sector shaped, i.e., extending radially outward from shaft 134 in an area on one side of the shaft. This sector shaped eccentric weight is hollow to provide a cavity 206 therewithin for receiving and permitting relative rotation of a second, solid, sector shaped eccentric weight 182. On the opposite side of the cavity 206, weight 138 joins a shaft extension or stub shaft 134' which rotates in bearings 136' positioned in a tubular section 210 of a bearing carrier 212, the latter being joined to a forward end or flange 214 secured between drum hub 148 and the drum by screws 155. The bearing carrier is bell shaped, extending axially inwardly in surrounding relation to weights 138 and 182 and supplying the support for bearings 136'. An interior bearing retaining ring 218 is secured to the inner end of tubular section 210.

Drum hub 148 is provided with an inner axial flange member 149 within which bearings 150 are received adapting the drum hub and the drum, as well as bearing carrier 212, to rotate with respect to shaft 134. Flange member 149 is also secured to a disk shaped inner bearing carrier wall 216 which has a sealing relation with the interior walls of the bearing carrier. An oil seal ring 154 is disposed between the drum hub 148 and member 121 to provide for sealing of bearing oil.

A phasing shaft 168 is positioned coaxially within hollow shaft 134 and has an exterior helical ribbed surface 169 which mates with a grooved interior helical surface provided on insert 220 secured within gear 130. Considering the gear 130 as an extension of shaft 134, the grooved surface of insert 220 is considered to extend for an appreciable length along shaft 134, while the ribbed outer surface 169 of phasing shaft 168 extends for an appreciable distance along the length of the phasing shaft, namely through the insert 220 to a position in the specific embodiment about half way between the insert and the eccentric weights 138 and 182. The nature of the ribbed and grooved mating surfaces on the phasing shaft 168 and insert 220 will be hereinafter more fully discussed. The remainder of the phasing shaft is necked down at 167 toward the eccentric weight and is provided with exterior straight splines 176 which mate with interior straight splines provided on a hollow shaft 222 surrounding the splined portion of the phasing shaft. Hollow shaft 222 is rotatably carried by bearings 224 disposed within the hollow interior of shaft 134. Shaft 222 has an external keyway 226 which receives a key 228 held in place by a roll pin 229 to interconnect shaft 222 and eccentric weight 182. The resulting splined and keyed connection between the phasing shaft and the weight 182 permits slidable movement while constraining the weight 182 for simultaneous rotation with phasing shaft 168.

The actuator arm 132 of cylinder 124 extends through a shroud member 230 and terminates in a yoke 232 having a pivotal connection with a bearing arm 234 supporting thrust bearings 172 in which the end of phasing shaft 168 is journaled. Movement of the actuator arm 132 through operation of hydraulic cylinder 124 causes axially inward and outward movement of the phasing shaft 168 with respect to insert 220, and since the two are provided with mating helical ribs and grooves, the phasing shaft is constrained to rotate with respect to shaft 134. Other suitable linear actuators, such as an electric actuator, could be used instead of the hydraulic cylinder for this purpose.

Rotation of the phasing shaft brings about simultaneous rotation of eccentric weight 182 with respect to eccentric weight 138. As a consequence, the relative positions of weights 138 and 182 are altered and the amplitude of the resulting vibration can be adjusted. This adjustment can be made while the shafts are either rotating or stationary. For instance, when the weights 138 and 182 are substantially aligned as shown in FIG. 2, the amplitude of vibration is maximum, but if hydraulic cylinder 124 is operated to withdraw the phasing shaft 168 to the left, eccentric weight 182 can be rotated to a position substantially diametrically opposite weight 138 in balancing relation thereto for minimizing or canceling the vibration. When the phasing shaft is in any particular position and is held in such position by the hydraulic cylinder 124, the relative positioning of weights 138 and 182 is maintained constant at a location bringing about a selected value of vibration amplitude. Of course, both weights are rotated from motor 122 as a result of the driving connection between the phasing shaft 168 and the mating insert 220 wherein the speed of rotation will determine the frequency of vibration.

The maximum "throw" of phasing shaft 168 is adjustable by means of adjusting stud 236 engaging a nut 238 welded to shroud 230. Lock nut 240 secures the stud in a given position. Stud 236 extends through the shroud and carries a bracket 242 for engaging bearing arm 234 and limiting the travel of phasing shaft 168 toward the left in FIG. 2. In a two-value amplitude system, i.e., where hydraulic cylinder 124 moves the phasing shaft between maximum amplitude and minimum amplitude positions, the extent of the difference in vibration amplitude between these two positions can be adjusted by means of stud 236.

The construction of the drum 112 of FIG. 2 to the right of hub 148 but not to the left of it is essentially repeated on each side of the vehicle, and a central shaft 244 suitably extends from the left side of the drum to a similar structure on the right (not shown). Central shaft 244 is splined at its left-hand end in a manner to mate with the straight splines in axial portion 222 of weight 182. The remote end of central shaft 244 similarly mates with the straight splines on the opposite side of the drum for bringing about simultaneous rotation of the weights on the right-hand side of the vehicle. Stub shaft 134' is also connected to its counterpart on the opposite side of the drum by a hollow central shaft 135. Shaft 135 is connected at its opposite ends to the two stub shafts by keys 137.

Figure 3:
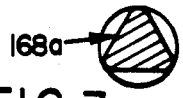
FIGS. 3 through 10 are cross-sectional and side views of phasing shafts as suitably employed according to the FIG. 2 embodiment.
Figure 5:
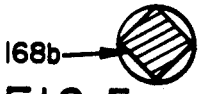
Figure 7:
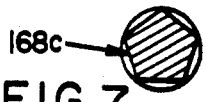
Figure 9:
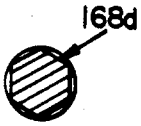
Figure 4:
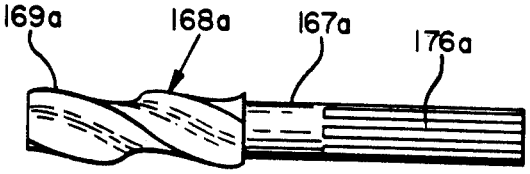
Figure 6:
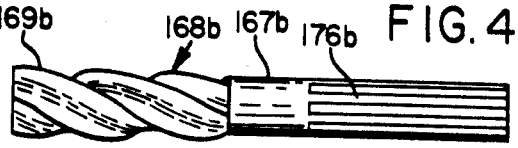
Figure 8:
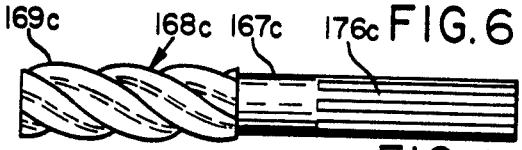
Figure 10:
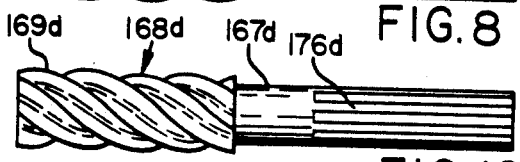

The phasing shaft 168 in the embodiment of FIG. 2 is polygonal in external transverse cross section, with the transverse cross section of insert 220 being internally polygonal to match. Polygonal is herein taken to mean having the outline of a polygon, broadly encompassing a figure having three or more sides. Thus, the present definition encompasses the triangular cross section of FIG. 3 and the square cross section of FIG. 5 as well as the pentagon and hexagon cross sections of FIGS. 7 and 9, respectively. As illustrated in FIGS. 4, 6, 8 and 10, the polygonal portions **169*a*–169*d* extend along an appreciable length of the phasing shaft, while the shaft is necked down at 167*a*–167*d* and provided with straight splines 176*a*–176*d* along an appreciable length thereof at the opposite end of the shaft for internally engaging the second eccentric weight in sliding relation. Phasing shafts constructed in this manner are found to have superior strength in bringing about relative rotational movement of the second or interior eccentric weight with respect to the first, and shafts constructed in this manner are also relatively simple in construction. Each of the polygonal surfaces of sections 169*a* through 169*d* proceed helically along the length thereof in a manner to describe a simple helix of constant ramp, and it is understood the internal configuration of insert 220 is similarly helical. The sides of the polygonal shapes 168*a*–168*d*** need not be flat, but can be concave, or preferably slightly convex.

While helical polygonal shapes are herein described as employed between the hollow first shaft and the phasing shaft, and straight splines are utilized between the phasing shaft and the second eccentric weight, it is understood the reverse can be true. That is, straight splines may be employed at the end of the phasing shaft that engages the interior of the insert 220, with a helical configuration being employed between the phasing shaft and the interior of second eccentric weight 182. As another alternative, both mating connections can be helical in configuration, bringing about a more rapid rotation of the weight 182 for a given axial movement of the phasing shaft. In any case, the phasing shaft configuration is desirably helically polygonal over a substantial length thereof, while the insert 220, considered to be an extension of shaft 134, is also helically polygonal over a substantial length thereof to bring about a simplified and heavy duty mechanism for relatively rotating the second eccentric weight even while the vehicle is in rolling operation.

While we have shown and described several embodiments of our invention, it will be apparent to those skilled in the art that many changes and modifications may be made without departing from our invention in its broader aspects. We therefore intend the appended claims to cover all such changes and modifications as fall within the true spirit and scope of our invention.

We claim:

1. A vibrator system for a drum employed in earth compaction or the like, said system comprising:

first and second eccentric weights positioned within said drum and adapted to be rotated within said drum to impart vibration thereto, a first shaft extending coaxially with respect to said drum, a first of said eccentric weights being mounted for rotation by said first shaft, means including a second shaft positioned coaxially with said first shaft for providing a driving connection comprising helical ribs and mating grooves between said first shaft and said second eccentric weight, said helical ribs and mating grooves comprising polygonal external and internal surfaces, means for rotating one of said shafts, and means for causing relative axial movement between said shafts such that said helical connection produces concurrent rotation of said second eccentric weight relative to said first eccentric weight and a change in the amplitude of vibration produced with rotation of said eccentric weights.

2. A vibratory compaction system comprising:

a frame, a drum and means rotatably mounting said drum to said frame, said drum having at least one end hub, a first shaft coaxial with said drum and extending through said hub, and means external to said drum for rotating said first shaft, first and second eccentric weights positioned within said drum and adapted to be rotated within said drum to impart vibration thereto, said first of said eccentric weights being mounted for rotation with said first shaft, means including a second shaft coaxial with said first shaft and providing a helical polygonal driving connection between said first shaft and said second eccentric weight, and means for imparting axial movement to said second shaft such that said helical polygonal connection produces concurrent rotation of said second eccentric weight relative to said first eccentric weight and a change in the amplitude of vibration produced by said eccentric weights.

3. A vibrator system for a drum employed in earth compaction or the like, said system comprising:

first and second eccentric weights positioned within said drum and adapted to be rotated within said drum to impart vibration thereto, a first shaft extending coaxially with respect to said drum, the first of said eccentric weights being mounted for rotation by said first shaft, a second shaft disposed coaxially with respect to said first shaft, the second of said eccentric weights being mounted on said second shaft for rotation therewith, and means for rotating one of said shafts, and a linear actuator axially engaging one of said shafts for bringing about relative longitudinal movement of said second shaft with respect to the first shaft, said second shaft having driving connections with said first shaft and with said second eccentric weight wherein at least one such driving connection is helical polygonal in form to provide relative rotation of said second eccentric weight with respect to said first shaft and said first eccentric weight for controlling the amplitude of vibration caused by said eccentric weights in response to said relative longitudinal movement of said second shaft, and to provide in the absence of said longitudinal movement rotation of said eccentric weights in the same direction and at a constant angular relationship to one another upon rotation of said one shaft.

4. A vibrator system for a drum employed in earth compaction or the like, said system comprising:

first and second eccentric weights positioned within said drum and adapted to be rotated within said drum to impart vibration thereto, a first shaft extending coaxially through the hub of said drum, the first of said eccentric weights being mounted for rotation by said first shaft, and means external to said drum for rotating said first shaft, a second shaft disposed coaxially with respect to said first shaft and having a driving connection with said second eccentric weight for rotating said second eccentric weight, said connection including axially slidable means allowing axial movement of said second shaft with respect to said second eccentric weight while constraining said second shaft and said second eccentric weight for simultaneous rotation, said first shaft having a driving connection with said second shaft for bringing about concurrent rotation of said shafts and said first and second eccentric weights, said last mentioned driving connection comprising a first internal helical polygonal surface on one of said shafts and a mating externally helical polygonal surface on the other shaft extending along an appreciable length thereof in engaging relation with said first helical polygonal surface, and a linear actuator external to said drum and axially engaging said second shaft for bringing about longitudinal movement of the said second shaft with respect to said first shaft and second eccentric weight, said helical polygonal shaft surfaces causing rotation of the said second shaft with respect to said first shaft to rotate said second eccentric weight and alter the angular position of said second eccentric weight with respect to said first eccentric weight and thereby alter the amplitude of the vibration caused by simultaneous rotation of said eccentric weights.

5. The system according to claim 4 wherein said eccentric weights are concentrically positioned.

6. A vibratory compaction system comprising:

a frame, a drum, and means rotatably mounting said drum to said frame, said drum having at least one end hub, a pair of shaft means coaxial with said drum at least a first of which extends through said hub, and means external to said drum for rotating said first of said shaft means, first and second eccentric weight means positioned within said drum and adapted to be rotated within said drum to impart vibration thereto, the first of said eccentric weight means being mounted for rotation with the first of said shaft means and the second of said eccentric weight means being mounted for rotation with the second of said shaft means, said first of said shaft means having a driving connection with the second of said shaft means for bringing about concurrent rotation of said first and second shaft means and said first and second eccentric weight means, said driving connection comprising helical ribs and mating grooves in the form of helical polygonal surfaces on said first and second shaft means along an appreciable length thereof whereby relative translational movement between said shaft means also brings about relative rotational movement therebetween, and actuator means mounted with respect to said frame for axially engaging the second of said shaft means for selectively causing longitudinal movement thereof and consequent rotation with respect to the first of said shaft means together with relative rotation of said first and second eccentric weight means for thereby altering the amplitude of vibration caused by rotation of said first and second eccentric weight means for thereby altering the amplitude of vibration caused by rotation of said eccentric weight means.

7. The system of claim 6 wherein said first eccentric weight means comprises a first pair of eccentric weights positioned near opposite ends of said drum, and said second eccentric weight means comprises a second pair of eccentric weights positioned near opposite ends of said drum.

8. The system of claim 7 wherein said first pair of eccentric weights are mounted concentrically with respect to said second pair of eccentric weights, and said first and second shaft means are concentrically mounted with respect to one another.

9. The system of claim 7 or 8 wherein said first and second pairs of eccentric weights are mounted on their respective first and second shaft means within bearing carriers within opposite ends of said drum, said bearing carriers being affixed to said drum to rotate therewith and supporting bearing means inwardly of the outer ends of said drum, said bearing means rotatably supporting said first shaft means for rotation relative to said drum.

10. The system of claim 6 wherein said second shaft means includes a shaft section of polygonal cross-sectional shape in the region of said driving connection.

11. The system of claim 10 wherein said polygonal shape is triangular.

12. The system of claim 10 wherein said polygonal shape is square.

13. The system of claim 10 wherein said polygonal shape is pentagonal

14. The system of claim 10 wherein said polygonal shape is hexagonal.

* * * * *